US005197383A

United States Patent [19]

Grégoire et al.

[11] Patent Number: 5,197,383

[45] Date of Patent: Mar. 30, 1993

[54] PRINT WHEEL LOCKING DEVICE FOR FRANKING MACHINES

[75] Inventors: Jean-Pierre Grégoire, Bagneux; Jean-Claude Maroutel, Orsay, both of France

[73] Assignee: Alcatel Satmam, Bagneux, France

[21] Appl. No.: 740,690

[22] Filed: Aug. 6, 1991

[30] Foreign Application Priority Data

Aug. 7, 1990 [FR] France ..... 90 10063

[51] Int. Cl.[5] ..... B41L 47/46

[52] U.S. Cl. ..... 101/91; 101/110

[58] Field of Search ..... 101/76, 91, 99, 110–111, 101/106; 74/422; 235/414.5, 424.8 R, 101

[56] References Cited

U.S. PATENT DOCUMENTS

| | | | |
|---|---|---|---|
| 4,140,054 | 2/1979 | Martin et al. | 101/91 |
| 4,520,725 | 6/1985 | Haug | 101/91 |
| 4,580,493 | 4/1986 | Sette | 101/91 |
| 4,604,950 | 8/1986 | Sette | 101/91 |
| 4,644,142 | 2/1987 | Payn | 235/101 |
| 4,858,525 | 8/1989 | Hubbard et al. | 74/424.8 R |
| 4,898,093 | 2/1990 | Haug | 101/91 |
| 5,050,495 | 9/1991 | Wu | 101/110 |
| 5,106,321 | 4/1992 | Harousel | 439/310 |

*Primary Examiner*—Eugene H. Eickholt
*Attorney, Agent, or Firm*—Sughrue, Mion, Zinn, Macpeak & Seas

[57] ABSTRACT

It is characterized in that it comprises a ring (70) with an internal semi-annular collar (71) mounted on and axially fixed to a rear part of a print head supporting sleeve (12) of the print head, opposite the drum, and coupled by means (76, 77) to an adjustment control system (40) mounted to oscillate about the rear part of the drum to couple it to sliding rods incorporating racks and carried by the sleeve.

9 Claims, 3 Drawing Sheets

PRINT WHEEL LOCKING DEVICE FOR FRANKING MACHINES

Figure 1:
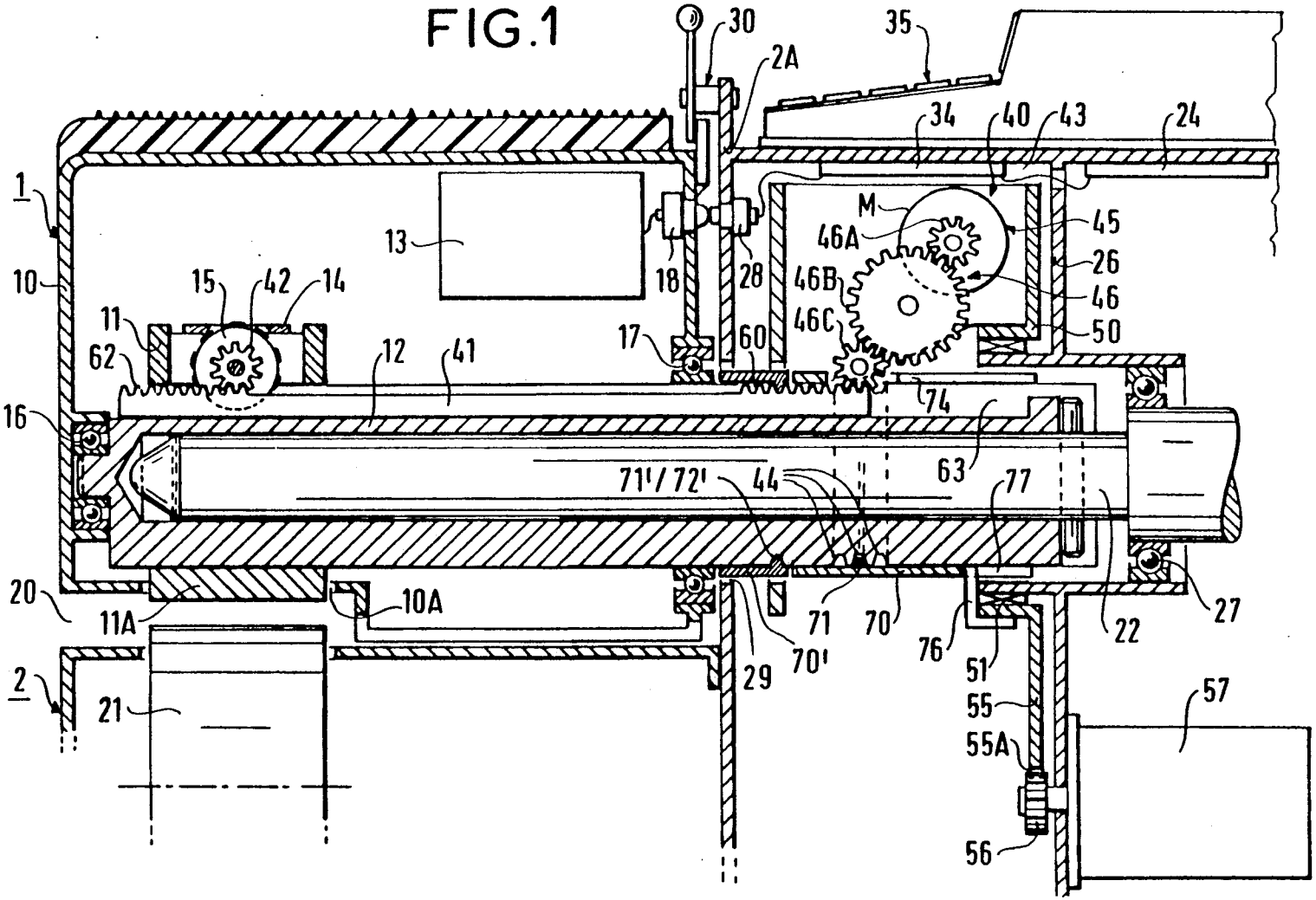

The present invention concerns franking machines with a print head removably mounted on a base unit in which the print head is a print drum carrying print wheels. It is more particularly concerned with a device for locking in position the print wheels in such machines.

Known print wheels are rotatably mounted on the print drum to enable their position to be adjusted when no franking operation is in progress. They project slightly from the periphery of the drum and rotate with it to print fixed and variable franking information on each rotation of the drum. The wheels print variable information: franking amount and date. The print drum therefore comprises two sets of wheel for this variable information, projecting from the drum through appropriate openings in a printing plate carrying the franking imprint. This printing plate is mated to the periphery of the drum and carries the fixed franking information in the form of the franking imprint or the imprint of the local post office or of any other kind. The same drum usually carries another printing plate for fixed promotional devices, similar to the first but often retractable. In some machines other printing means such as one or more retractable stamps are associated with the drum.

To adjust their position the print wheels are in a known way coupled to a motor-driven or manual driving gear control system by rack rods driven by the driving gears and driving driven gears on the print wheels. The motor-driven control system is connected to a control circuit board mounted in the base unit and connected to data entry means such as a keyboard and display screen on the machine.

An object of the present invention is, when the adjustment has been carried out, to lock the racks and the print wheels in position as they rotate with the drum during each print cycle.

The present invention consists in print wheel locking device for franking machines with a print head removably mounted on a base unit and print wheel adjustment means, wherein:

the print head comprises a print drum carrying said print wheels and a rotary sleeve carrying said print drum at a front end with its rear end projecting from the print head, the base unit comprises at least a control circuit board, drive means coupled to the control circuit board and a rotary shaft coupled to the drive means and accessible on the base unit for interengagement with the sleeve and driving the sleeve in rotation with it, and the print wheel adjustment means comprise rods with front and rear racks mounted side by side and slidably along the sleeve and coupled by said front racks to the various print wheels, and an adjustment control system mounted to oscillate about the sleeve and the rear rack an coupled to the control circuit board for selectively coupling it to at least one group of rear racks, the locking device being characterized in that it comprises:

a first ring mounted on the rear end part of the sleeve and the rear racks, fixed in the axial direction with respect to the sleeve and rotatable thereon, and providing access for said adjustment control system to the group of rear racks for adjustment of the print wheels concerned, a first inner peripheral semi-annular member in the first ring and first outer complementary means on the sleeve, engaged one with the other, said first semi-peripheral member having a cross-section complementary to any tooth segment of the rear racks, for their interengagement, and means for rotationally coupling said ring and said adjustment control system for relative driving of the first ring with said system relative to the sleeve.

According to another feature of the invention, said first annular member is a collar projecting into the first ring, truncated at leave over the access for the adjustment control system, and the first complementary means is a groove on the sleeve passing through a gap between teeth of the various rear racks.

According to another feature of the invention, said first ring fixed axially to the sleeve is part of said print head and has an open access slot at the end of the first ring alongside the rear end of the sleeve defining said access to the rear racks for said adjustment control system mounted in the base unit as an interface for the print head.

According to another feature of the invention, the locking device further comprises:

a second ring mounted adjacent the first ring of the rear part of the sleeve and on the rear rack, being fixed axially relative to the sleeve and adapted to oscillate about the sleeve, independently of the first ring, a second inner annular member on the second ring with notches in corresponding relationship to the various respective rear racks engaged in second complementary means on the sleeve, said second member being complementary to any tooth segment of the rear rack, and actuator means for said second ring, to oscillate it between a rack locking position in which the notches are offset from the rear rack and an adjustment position in which the notches are in line with said various rear racks to enable adjustment thereof.

Figure 2:
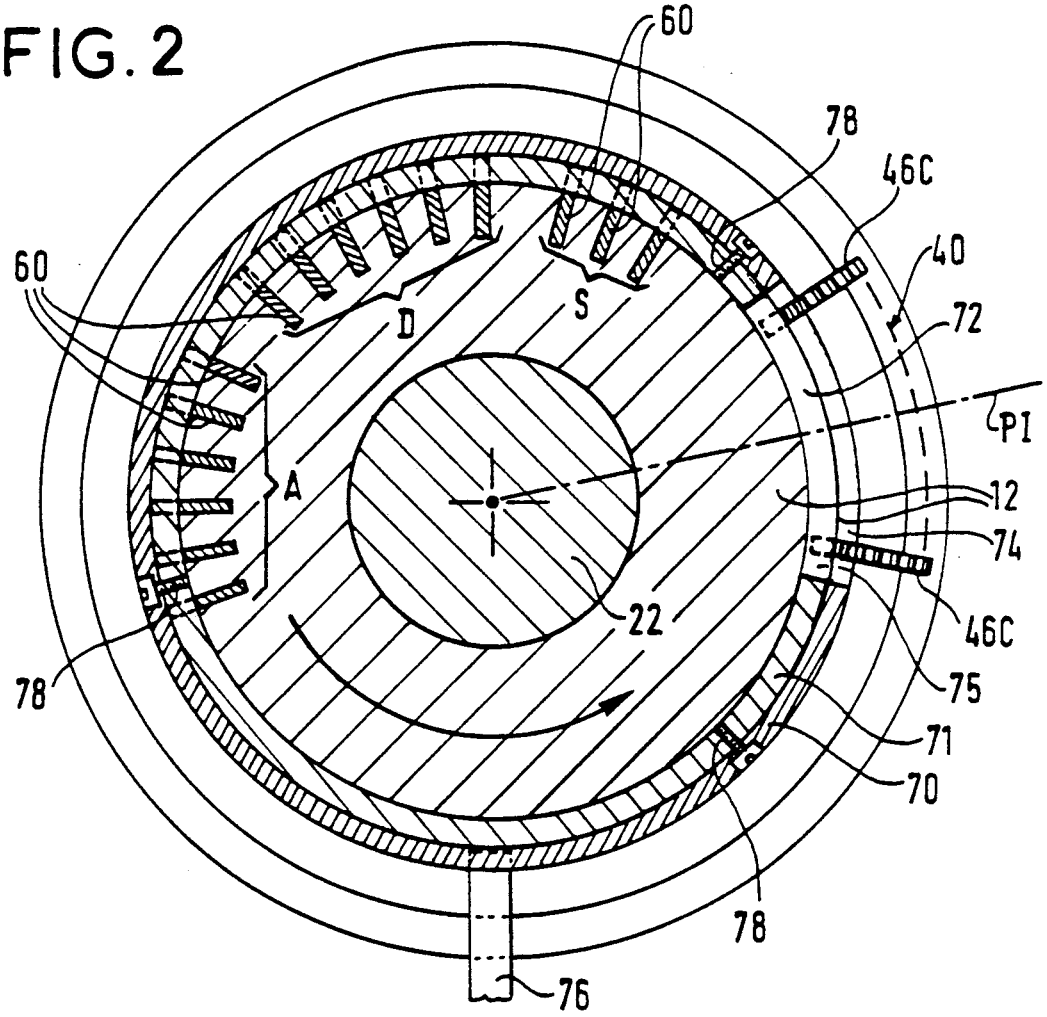
Figure 3:
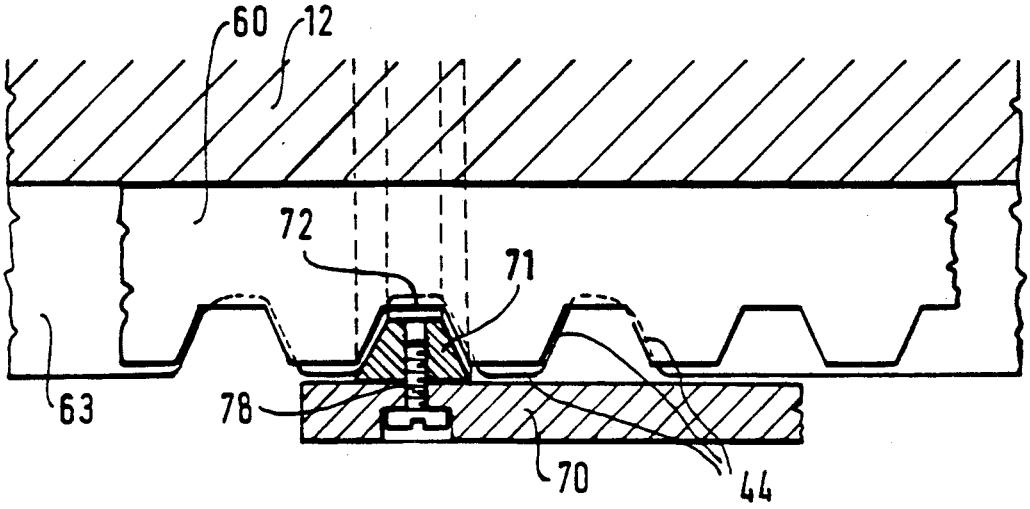
Figure 4:
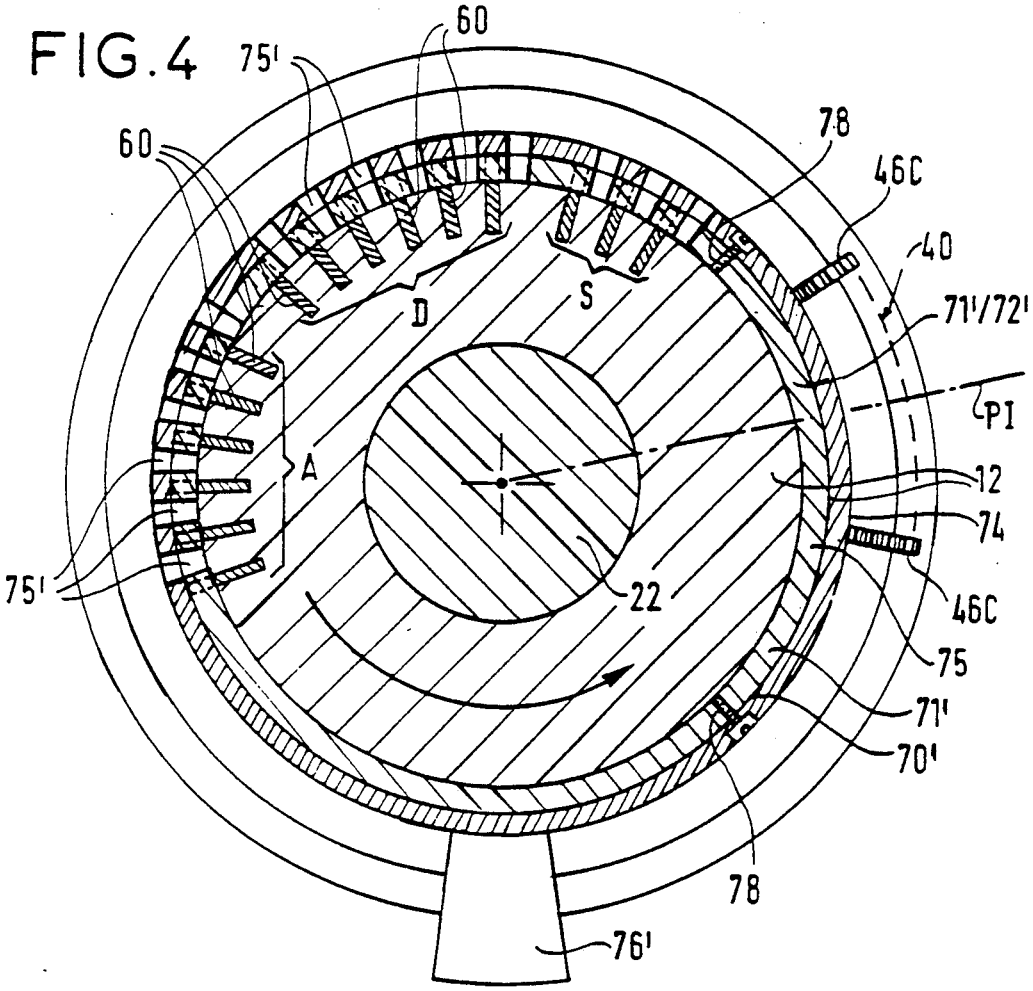
Figure 5:
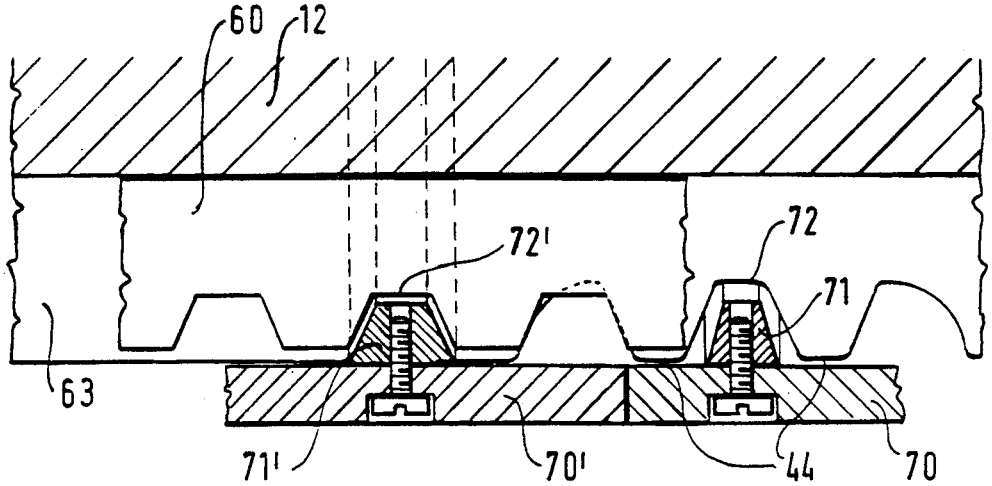

The characteristics and advantages of the present invention will emerge from the description of a preferred embodiment shown in the appended drawings. In these drawings:

FIG. 1 is a schematic view in partial cross-section of a franking machine equipped with a locking device in accordance with the present invention, FIG. 2 is a schematic view in transverse cross-section of FIG. 1 in the plane of a first ring of the locking device, FIG. 3 is a schematic view in partial longitudinal cross-section of FIG. 2, FIGS. 4 and 5 are analogous to FIGS. 2 and 3 and are a schematic view in cross-section in the plane of a second ring of the locking device and the corresponding longitudinal schematic cross-section.

The franking machine is the subject of French patent application No 90 08 752 filed Jul. 10, 1990 in the name of the present applicant. This machine is described in the present application with reference to FIG. 1 and/or FIG. 2 only in respect of the mounting of the print head on the base unit.

The machine has a removable print head 1 mounted on a base unit 2. The print head is accommodated in a housing for it in the front of the base unit, against a set back front wall 2A of the base unit.

The print head 1 is a secure unit, the various component parts of which are mounted within a virtually closed module 10 which the user is not authorized to access. It essentially comprises a print drum 11, a sleeve 12 and a circuit board 13 carrying the accounting circuits of the machine.

The drum 11 has a flat 11A which is flush with the bottom of the module through an aperture 10A when the drum is in an idle position. It carries on its periphery a printing plate 14 for printing the franking or local office imprint and two sets of print wheels (15, etc) projecting through the plate 14 for printing the franking amount and the date. The drum also carries means for printing promotional devices, similar to the printing plate 14 but retractable, or is associated with retractable additional printing means such as stamps at one or more positions. These additional printing means are known in themselves and are not shown.

The sleeve 12 carries the drum on its front end part inside the print head. Its rear end part projects from the rear of the print head. It is rotatably mounted in the print head between two roller bearings 16 and 17.

The accounting circuit board 13 is connected to a connector 18 to connect it to the base unit.

The base unit 2 is a separate assembly to which access is unrestricted. It includes a slot 20 through which mail items can be passed under the print head. It incorporates a printing pressure roller 21, a shaft 22, a mechanism for driving the shaft and the pressure roller (not shown), and at least one base unit and print head control circuit board 24.

The shaft 22 is horizontal. It is rotatably mounted in the base unit by roller bearings such as the roller bearing 27 on an intermediate crossmember 26. Its front end part projects into the location for the print head on the base, through a large aperture 29 in a front wall 2A.

When the print head is fitted, the rear part of the sleeve is inserted into the base unit, the sleeve 12 locks onto the shaft 22 to rotate with it and a connector 28 on the base unit and the connector 18 on the print head provide the electrical connection between the print head and the base unit. A mechanism 30 locks the print head in position on the base unit.

The base unit 2 further comprises a data entry and display unit 35 in the form of a keypad and associated display screen. These are mounted on the upper surface of the base unit and connected to the control circuit board 24.

The machine is further provided with a print wheel adjustment device, which is known in itself or preferably conforms to the patent application by this applicant with the same filing date as the present application and the title "Print wheel adjustment device for franking machines".

The adjustment device shown in FIG. 1 is as disclosed in the aforementioned application.

It comprises a control system 40 and, for the various print wheels, respective sliding rods 41 carrying toothed racks and driven gears 42.

The control system 40 is mounted within the base unit 2, but the sliding rods 41 and the driven gears 42 are part of the print head. The control system is accommodated within an annular housing 43 around the sleeve on the shaft, between the crossmember 26 in the base unit and the front wall 2A. Within the base unit 2 it constitutes a control interface for adjustment of the print wheels of the print head 1, and is so designated hereinafter. Within the base unit, it receives adjustment control signals from the control circuit board 24 via an interconnect circuit board 34.

The control interface 40 comprises a set 45 of motors M and a set 46 of driving gears in cascade, there being one cascade of driving gears for each motor. Each cascade is formed in this example of three driving gears, meshing with each other and driven by the respective motor: a gear 46A is driven by the motor and drives an intermediate gear 46B which drives the third gear 46C which drives one of the sliding rods.

The number of individual motors and cascades of driving gears 46 is advantageously six to suit the six franking or date print wheels.

The control interface 40 is mounted to oscillate within its housing 43 around the sleeve on the shaft. Its angular position on the sleeve, when idle, is controlled by orientation control signals from the control circuit board 24. A semi-annular groove 44 on the rear part of the sleeve provides space for the driving gears 46C when activated. The profile of this groove matches three teeth of the driving gear 46C.

The control interface is mounted on a hub 50 centered on the sleeve on the shaft. The hub is carried by the crossmember 26 in a smooth bearing 51. The vertical shoulder of the hub 50 parallel to the front and rear walls of the base unit and substantially in contact with the crossmember 26 forms a toothed ring 55 with semi-peripheral teeth 55A. A gear 56 meshes with the teeth 55A. It is mounted on the shaft of an angular position control motor 57 connected to the control circuit board 24 and mounted behind the crossmember 26.

The driven gears 42 are mounted directly on the spindle of the respective print wheel.

The sliding rods are identical to each other. Each comprises a rear rack 60 for coupling them to the driving gears 46C and a front rack 62 coupled to each of the driven gears at their respective ends. They extend side by side along generatrices of the sleeve, and are housed in longitudinal grooves 63 on the sleeve, allowing access to the racks by the driving gears 46C and the driven gears 42.

Referring to FIG. 2, the sliding rods or the racks thereof, such as the rear racks 60, form a group A of six elements assigned to adjusting the franking print wheels, another group D of six other elements assigned to adjusting the date print wheels and a third group S of three further elements assigned to adjusting additional print wheels. These additional print wheels are mounted in exactly the same way as the previous ones on the drum but control separate additional print means associated with the drum.

The print wheel locking device in accordance with the invention is described first with reference to FIGS. 1 through 3 and then with reference to FIGS. 1, 4 and 5.

It comprises a ring 70 which can rotate about the sleeve 12 and rear racks 60 and which is coupled to the adjustment control system 40. The ring is driven with the control system 40 relative to the sleeve for the operations of adjusting the print wheels and during each franking operation.

In the franking machine as previously described, with an adjustment control system 40 advantageously mounted as an interface within the base unit 2 for the print head 1, the ring 70 is mounted on the rear end part of the sleeve to which it is fixed in the axial direction. It is part of the print head and remains attached to the sleeve when the print head is removed from the base unit.

The ring 70 incorporates an open annular inner collar or annular inner member 71 the cross-section of which is complementary to the spaces between the teeth of the rear racks 60. The rear end part of the sleeve 12 incorporates an annular groove 72 complementary to the collar 71 and passing through a gap between teeth of the rear racks. The collar is engaged in the groove 72 and in a gap between teeth of the various racks, in particular in the idle position or the position in which the print head is inserted into the base unit, denoted PI on an axis of symmetry of the system 40 in FIG. 2. It remains engaged in the groove 72 and in the gap between teeth of the rear racks of two of the groups A, D and F when the print wheels for the third group of rear racks are adjusted.

As an alternative, the ring may incorporate a semiannular internal groove in corresponding relationship to a rack tooth and the sleeve may incorporate a projecting annular rib complementary to it and to a rack tooth, the rib being interrupted by the grooves 63 for the racks.

The ring further incorporates an access slot 74 for the system 40 to the rear racks 60. The width of the access slot 74 is equivalent to the six racks of the group A or D for the six driving gears 46C which can mesh with them. It is open at the rear end of the sleeve, for insertion and longitudinal positioning of the driving gears 46 in the slot when the print head is inserted into the base unit. The access slot 74 interrupts the annular collar over a corresponding sector 75.

The means for coupling the ring 70 to the control system 40 comprise a finger 76 on the hub 50 projecting inwardly towards the sleeve mounted on the shaft and a coupling slot 77 on the ring. The coupling slot 77 is open at the rear end of the sleeve for inserting the finger 76 into the slot and sliding it along the slot when the print head is mounted on the base unit. The finger 76 retained within the width of the slot causes the ring and the adjustment control system 40 to rotate together relative to the sleeve, when the system 40 is oriented angularly, at which time the sleeve remains at rest, and during franking operations at which time the system 40 remains fixed in the base unit.

The locking device preferably further comprises a second ring 70' to ensure perfect locking of the racks. The second ring 70' is mounted on the sleeve and the rear rack and fixed relative thereto in the axial direction, like the first ring 70. It also oscillates around the sleeve like the first ring, but locks the racks in position only for adjustment thereof.

The second ring 70' incorporates an annular inner collar or annular inner member 71' complementary to a gap between teeth of the rack on its periphery which is interrupted by three series of notches 75' which discharge through the ring 70' or, in an alternative embodiment, do not discharge through the ring. These series of notches 75' are in corresponding relationship to the respective series of racks A, D, S and provide access to the rear racks only for adjustment of one or other of the three series.

In corresponding relationship to the collar 71' is a peripheral groove 72' on the sleeve in which it is engaged.

The ring 70' carries an actuator member 76' oscillating about the sleeve from a rack locking position, which constitutes its normal position and in which the notches 75' are between the racks of the various groups, as shown, and an adjustment enable position in which the grooves 75' are lined up with the various racks.

The controlled oscillation is by a half-pitch of the racks of a same group or an integer number of pitches plus a half-pitch. It is transmitted to the member 76' either from the system 40 or from the control circuit board 24 by a motor or some other means such as a solenoid, actuator or the like. It places the ring 70' in the adjustment enable position immediately before the adjustment of a group of print wheels and in the rack locking position immediately after each adjustment.

Of course, the collar 71' could be replaced with a groove with teeth replacing the notches 75' and a rib replacing the groove 72' on the sleeve.

The relative arrangement of the two rings 70 and 70' and their respective collars will now be explained.

The ring 70 is mounted at the end of the sleeve, with its collar 71 centered in the profile of the groove 44. The ring 70' is mounted inwardly of the ring 70 on the sleeve.

The ring 71 procures loose locking of the rear racks which are locked fully by the collar 71'.

As shown in FIG. 3 or 5, the collar 71 or 71' is preferably attached to the ring. It is fixed into the ring by pins or screws 78, etc. Of course, any other suitable way of attaching the collar to the ring may be used, or the collar may be manufactured in one piece with the ring.

The ring 70 is mounted on the rear end of the sleeve by exploiting the elasticity conferred upon it by the slots 74 and 77 or by manufacturing it in two or more parts which are fastened together. The ring 70' is preferably in several parts.

Note that when the print wheels are adjusted the rear racks of the sliding rods that are not involved in the current adjustment are locked fully by the collar 71 whereas the collar 71' leaves them all unlocked. In normal operation of the machine, when the sleeve rotates with the sliding rods, the rear racks are locked by the collar 71 and, in the sector 75 with no collar, by the driving gears 46C of the system, and additionally by the collar 71'.

There is claimed:

1. Print wheel locking device for franking machines with a print head removably mounted on a base unit and print wheel adjustment means, wherein:

the print head comprises a print drum carrying said print wheels and a rotary sleeve carrying said print drum at a front end with its rear end projecting from the print head, the base unit comprises at least a control circuit board, drive means coupled to the control circuit board and a rotary shaft coupled to drive means and accessible on the base unit for interengagement with the sleeve and driving the sleeve in rotation with it, and the print wheel adjustment means comprise rods with front and rear racks mounted side by side and slidably along the sleeve and coupled by said front racks to the various print wheels, and an adjustment control system mounted to oscillate about the sleeve and the rear rack and coupled to the control circuit board for selectively coupling it to at least one group of rear racks, the locking device being characterized in that it comprises:

a first ring (70) mounted on the rear end part of the sleeve (12) and the rear racks (60), fixed in the axial direction with respect to the sleeve and rotatable thereon, and providing access (74) for said adjustment control system to the group of rear racks for adjustment of the print wheels concerned, a first annular inner member (71) in the first ring and first outer complementary means (72) on the sleeve, engaged one with the other, said first semi-peripheral member having a cross-section complementary to any tooth segment of the rear racks, for their interengagement, and means (76, 77) for rotationally coupling said ring and said adjustment control system (40) for relative driving of the first ring with said system relative to the sleeve.

2. Device according to claim 1 characterized in that said first annular inner member (71) is a collar projecting into the first ring, truncated at least over the access (74) for the adjustment control system, and the first complementary means (72) is a groove on the sleeve passing through a gap between teeth of the various rear racks.

3. Device according to claim 2 characterized in that said collar (71) is attached and fixed into the first ring.

4. Device according to claim 1 characterized in that said first annular inner member (71) is an inside groove in the first ring and said first complementary means is an annular rib projecting on the sleeve in corresponding relationship to a rack tooth.

5. Device according to claim 1 characterized in that said coupling means comprise a finger (76) carried by one of the elements formed by the first ring (70) and the adjustment control system (40) and locked substantially without angular clearance in the other such element.

6. Device according to claim 5 characterized in that said first ring (70) fixed axially to the sleeve (12) is part of said print head and has an open access slot (74) at the end of the first ring alongside the rear end of the sleeve defining said access (74) to the rear racks for said adjustment control system (40) mounted in the base unit (2) as an interface for the print head (1).

7. Device according to claim 6 characterized in that said coupling means (76, 77) comprise a coupling slot (77) on one of the elements defined by said first ring and said adjustment control system open on one side for engagement with and sliding of the finger (76) of the other element in the coupling slot when the print head is mounted on the base unit.

8. Device according to claim 5, wherein said access (74) for said coupling system to the rear rack (60) is in substantially corresponding relationship to a group (A, D) of rear racks assigned to a common franking or date function and coupled simultaneously to the control system, and said first annular inner member (71) of the first ring extends substantially to either side of the edges of said access (74).

9. Device according to claim 1 further comprising:

a second ring (70') mounted adjacent the first ring (70) of the rear part of the sleeve and on the rear rack, being fixed axially relative to the sleeve and adapted to oscillate about the sleeve, independently of the first ring (70), a second annular inner member (71') on the second ring (70') with notches (75') in corresponding relationship to the various respective rear racks engaged in second complementary means (72') on the sleeve, said second member (71') being complementary to any tooth segment of the rear rack, and actuator means (76') for said second ring, to oscillate said second ring between a rack locking position in which the notches are offset from the rear rack and an adjustment position in which the notches are in line with said various rear racks to enable adjustment thereof.

* * * * *